United States Patent [19]

Dolan

[11] 4,129,297

[45] Dec. 12, 1978

[54] ARM WRESTLING DEVICE

[76] Inventor: John W. Dolan, 194 Rustic Rd., Lake Ronkonkoma, N.Y. 11779

[21] Appl. No.: 658,721

[22] Filed: Jun. 14, 1976

[51] Int. Cl.[2] ..... A63B 5/00

[52] U.S. Cl. ..... 272/67; 272/142

[58] Field of Search ..... 272/67, 68, 142, 136, 272/135, 130; 188/266; 267/73, 74; 16/84, 85, 66

[56] References Cited

U.S. PATENT DOCUMENTS

| | | | |
|---|---|---|---|
| 911,925 | 2/1909 | Zeno | 272/142 X |
| 2,223,309 | 11/1940 | Swanson | 272/142 X |
| 2,543,565 | 2/1951 | Billingsley | 16/66 |
| 3,563,542 | 2/1971 | Wellman | 272/135 |
| 3,633,907 | 1/1972 | Cane | 272/142 |
| 3,662,602 | 5/1972 | Weiss | 272/67 X |
| 3,947,025 | 3/1976 | Hobby | 272/135 |
| 4,026,548 | 5/1977 | Birdwell | 272/900 |

FOREIGN PATENT DOCUMENTS

| | | | |
|---|---|---|---|
| 604340 | 5/1960 | Italy | 272/83 R |

*Primary Examiner*—Richard C. Pinkham
*Assistant Examiner*—William R. Browne
*Attorney, Agent, or Firm*—Stephen E. Feldman; Marvin Feldman

[57] ABSTRACT

An arm wrestling device is disclosed comprising a base, a channel mounted to the base, an arm pivotally mounted to and within said channel, and a hand grip transversely disposed to and attached to said arm and a spring disposed in said channel and mounted at one end to the upper portion of the arm and pivotally mounted at the other end adjacent the base, whereby the user grips and pulls the hand grip causing pivoting of the arm and pivoting and extension of the spring. The spring means is mounted in a retractable cylinder and further comprises an air brake to counter the retraction of the spring in the event of sudden release of the grip by the user. The spring is within a retractably extensible cylinder. The cylinder has an air brake to counter retraction of the spring upon release of the hand grip.

3 Claims, 8 Drawing Figures

ARM WRESTLING DEVICE

This invention relates to the improvement in the methods of mechanical arm wrestling. Arm wrestling for the purpose of amusement, muscular and coordinational therapy, athletic competition and physical exercise will be improved and enhanced by the use of the arm wrestling device of this invention.

It is the object of this invention to provide a means of arm wrestling wherein the device acts as a surrogate opponent by providing resistance to the muscular pressure exerted by the person operating the device for the purpose of amusement, muscular or coordinational therapy, athletic competition or physical exercise.

As illustrative of one preferred form of device in which my invention may be embodied, I have shown on the accompanying drawings, mechanism according to the above description numbered as follows.

Figure 1:
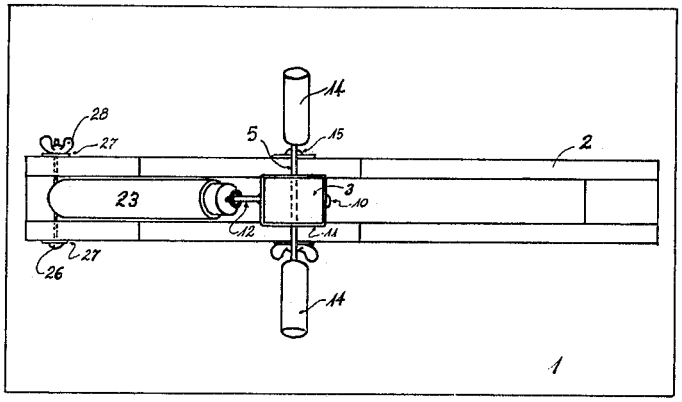
FIG. 1 is a top view of the Arm Wrestling Device.

The mechanism for carrying out this invention is as follows:

A. A base

B. A channel

C. An operating arm with hand grips

D. A spring assembly

The base (1) is made of a durable hard-surfaced material 36 inches long, 20 inches wide and 1 inch thick. This base (1) may be clamped or bolted to a table or suitable stand to prevent its movement or "walking".

The walls of the channel (2) are made of the same type material as the base (1), each wall 1 inch thick and spaced 2 inches plus apart and shaped thus: at one end (called the "spring" end for descriptive purposes) the walls are 5 inches high and 6 inches long, then sloping downward to a point 18 inches forward to a height of 2 inches and continuing at that height for another 16 inches, thereby making the channel (2) 34 inches in length. This channel (2) is fastened securely to the base (1) by screws, nails or glue or a combination of such in the width center and positioned 1 inch from either end of the short side of the base (1).

Figure 7:
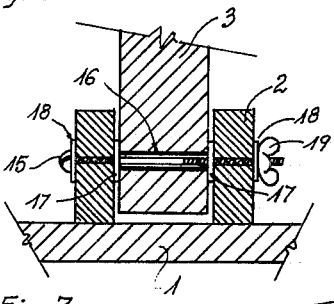
FIG. 7 is a schematic diagram of the main axis.
Figure 8:
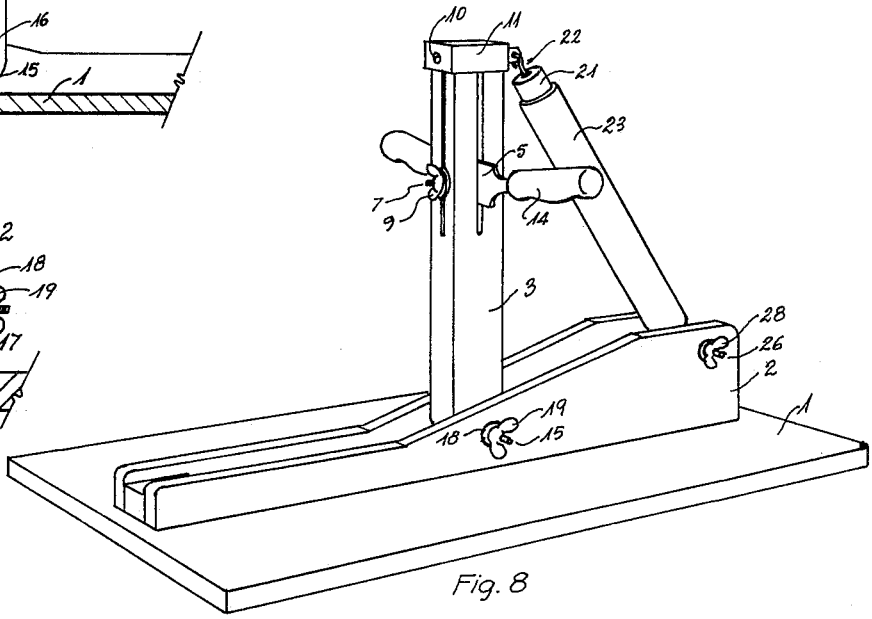
FIG. 8 is a perspective view of the Arm Wrestling Device.

The operating arm (3) is also composed of the same type of durable hard surfaced material as the base (1) and the channel (2). It is overall 20 inches in length, 3 inches wide and 2 inches thick. The bottom end is rounded on the 3 inch width dimension to facilitate free movement on an axis (FIG. 7).

The operating arm (3) is slotted at right angles at the top end running vertically lengthwise down the center for a distance of 9½ inches.

The slot (4) on the two broad faces of the operating arm (3) is ¼ inch in width to accommodate the hand grip plate (5).

The slot (6) on the two narrow faces of the operating arm (3) is for the accommodation of the hand grip height adjustment bolt (7) which passes through the operating arm (3) and is secured with washers (8, 8) and a wing nut (9).

Figure 2:
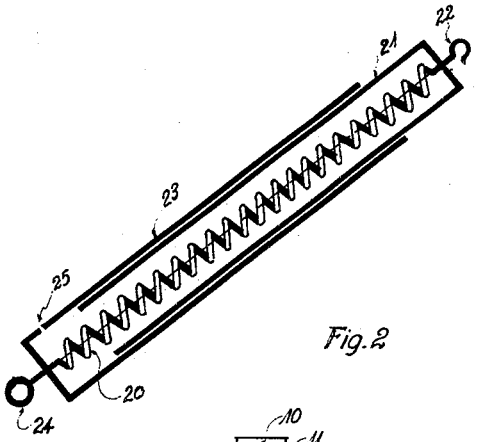
FIG. 2 is a schematic diagram of the operating spring assembly.
Figure 3:
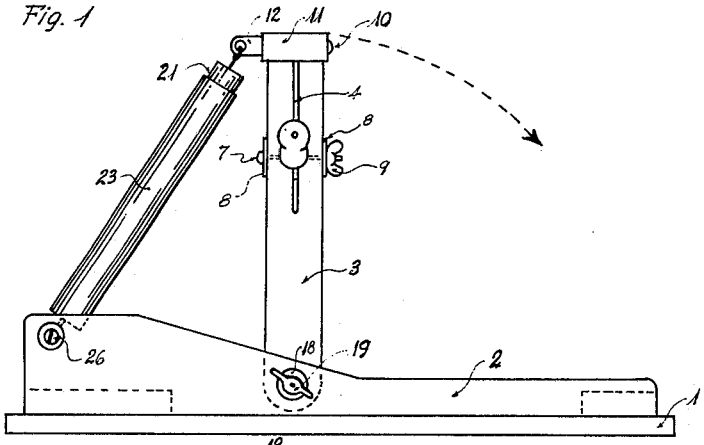
FIG. 3 is a side elevation of the Arm Wrestling Device in a normal position.
Figure 4:
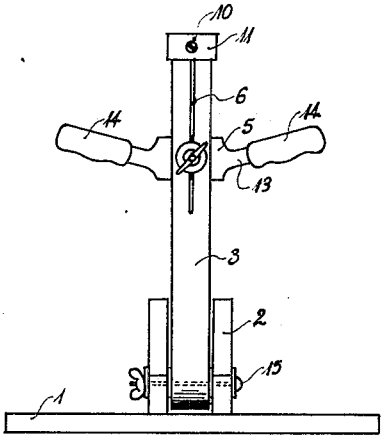
FIG. 4 is a front elevation.

Fitting laterally around the top end of the operating arm (3) and fastened securely with a set screw (10) is a 1½ inch band of thin metal (11) which reinforces the operating arm (3). Attached to this metal band (11) on the narrowest face of the operating arm (3) is an eye (12) which serves as a connector for the upper end of the spring assembly (FIG. 2) to the operating arm (3).

The hand grip plate (5) is made of a ¼ inch rectangular metal plate, 2 inches high and 4 inches wide. From its two upper corners, extending laterally at a 20° angle are two extensions (13, 13), each ½ inch in diameter and 4½ inches long. These are fitted with bicycle grips (14, 14) or other similar covering material. The plate (5) is fitted in the ¼ inch vertical slot (4) on the broad side of the operating arm (3) so that the extending hand grip extensions (13, 13) are at right angles to the operating arm (3).

In the center of the hand grip plate (5) is a ⅛ inch hole to accommodate the height adjustment bolt (7). This is a ⅛ inch wing bolt with washers (8, 8) on each side of the operating arm (3) and fastened with a wing nut (9) on the opposite side. This height adjustment bolt (7) rides in the slot (6) on the narrow face of the operating arm (3) so that the hand grip plate (5) may be adjusted to varying vertical positions to insure a comfortable position for the operator.

At a point 14½ inches from the spring end of the channel (2) and 1½ inches plus from the base (1) a 5/16 inch wing bolt (15) transfixes both walls of the channel (2) and the lower rounded end of the operating arm (3) 1½ inches from its end and through its broad face. This bolt is fitted with a bushing (16, FIG. 7) and interior washers (17, 17, FIG. 7), exterior washers (18, 18, FIG. 7) and fastened with a wing nut (19, FIG. 7). The connector eye (12) on the top reinforcing band (11) faces the spring side of the channel (2).

The operating spring assembly (FIG. 2) is composed of a 1⅞ inch helical spring (20) 17 inches long encased in a cylindrical metal tube (21) 15½ inches in length a 2 inches minus in diameter. One end of the tube (21) is sealed and has a hook (22) attached to its end for attachment to the operating arm (3) at the connector eye (12). The spring (20) is fastened at one end inside the tube (21). This tube (21) becomes an inverted piston by fitting its open end and the spring (20) into a larger diameter cylindrical metal tube (23) of extremely close tolerance, thereby becoming the piston's (21) chamber (23).

The larger cylinder or chamber (23) has a sealed end and an eyelet (24) for attachment to a point within the channel (2) described below. It is equipped with an air intake and exhaust port (25) of appropriate diameter.

Figure 5:
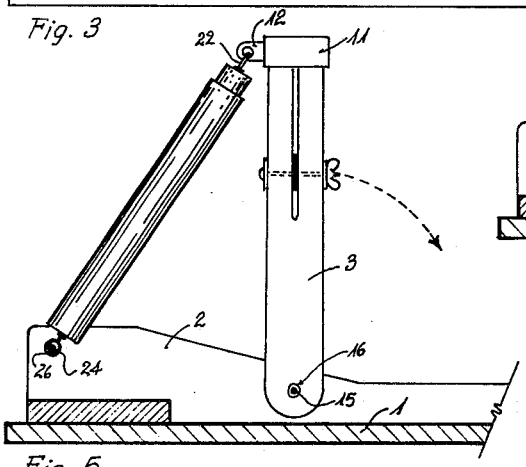
FIG. 5 is a section of the Arm Wrestling Device in normal position.

The opposite end of the spring (20) is fastened inside at the sealed end of the larger cylinder (23) in a compressed or normal position (FIG. 5).

There are two purposes for the cylinder (23) and piston (21) as part of the operating spring assembly (FIG. 2):

(1) To provide a guide for a straight unencumbered pull on the spring (20).

(2) To act as a pneumatic brake countering the retraction of the spring (20) should the operating arm (3) be suddenly released.

At a point 1½ inches from the top and 1½ inches from the spring end of the channel (2) a ¼ inch wing bolt (26) transfixes both walls of the channel (2) and is fastened with washers (27, 27) and a wing nut (28). The lower end of the operating spring assembly (FIG. 2) is attached to this bolt (26) by means of the eyelet (24) and the upper end to the connector eye (12) on the upper end of the operating arm (3).

Figure 6:
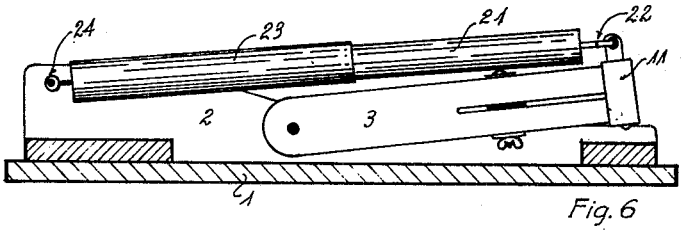
FIG. 6 is a section of the Arm Wrestling Device in an expanded position.

Operation of the Arm Wrestling Device is effected by the operator's placing his elbow on the base (1), grasping one of the hand grip extensions (13), and by a forward pivoting thrust of his forearm, attempts to expand the operating spring (20, FIG. 6).

The resistance of the operating spring assembly (FIG. 2) to the force exerted by the operator can be graduated by interchangeable spring assemblies of various strengths.

This procedure and the application of the mechanism of the device above described is the preferred procedure and application; however, numerous changes in minor details may be effected or carried out without departing from the scope or the intent of the invention of the Arm Wrestling Device.

I claim:

1. An arm wrestling device comprising a base, a channel mounted to the base, wherein the channel is sized so as to receive an arm in the pivoting of the arm, and guide the arm therein, the arm pivotally mounted to and within said channel, and a hand grip transversely disposed to and attached to said arm, and spring means disposed in said channel and mounted at one end to the upper portion of the arm and pivotally mounted at the other end adjacent the base, said spring means being mounted in a retractably extensible cylinder, and said cylinder further comprising air brake means, to counter the retraction of the spring upon release of the hand grip, whereby the user grips and pulls the hand grip causing pivoting of the arm and pivoting and extension of the spring means.

2. The arm wrestling device of claim 1, further comprising means to adjust the position of the hand grip along the arm, so as to change the height of the grip in relation to the base.

3. The arm wrestling device of claim 1, further comprising a second hand grip disposed on opposite sides of the arm from the first hand grip, and further comprising means to adjust the position of the hand grip along the arm, so as to change the height of the grip in relation to the base.

* * * * *